US005878473A

United States Patent [19]

Dillon et al.

[11] Patent Number: 5,878,473

[45] Date of Patent: Mar. 9, 1999

[54] METHOD FOR ALIGNING TUBE BRACKET HOLES

[75] Inventors: Roderick B. Dillon; Jack E. Simmons; Fouad Albahrani; Ronald E. Smith; Karl J. Goede, all of Ft. Wayne, Ind.

[73] Assignee: Dana Corporation, Toledo, Ohio

[21] Appl. No.: 773,052

[22] Filed: Dec. 24, 1996

[51] Int. Cl.[6] ..... B23P 17/00

[52] U.S. Cl. ..... 29/407.09; 29/465; 33/286; 33/644; 83/522.15

[58] Field of Search ..... 29/407.04, 407.09, 29/465; 33/286, 644, 645, 587; 83/522.15, 522.16, 522.17, 522.23, 522.24

[56] References Cited

U.S. PATENT DOCUMENTS

| | | | |
|---|---|---|---|
| 1,740,374 | 12/1929 | Sheehan | 83/522.17 |
| 1,895,589 | 1/1933 | Spatta . | |
| 2,783,840 | 3/1957 | Snorek | 164/46 |
| 2,829,983 | 4/1958 | Gain | 164/108 |
| 3,099,182 | 7/1963 | Alverson | 83/383 |
| 3,698,274 | 10/1972 | Coulon et al. | 83/188 |
| 3,987,696 | 10/1976 | Haas | 83/532 |
| 4,815,348 | 3/1989 | Ashbolt et al. | 83/383 |
| 4,885,967 | 12/1989 | Bell | 83/520 |

*Primary Examiner*—S. Thomas Hughes
*Assistant Examiner*—Steve Blount
*Attorney, Agent, or Firm*—Oldham & Oldham Co., LPA

[57] ABSTRACT

A method for providing an article of manufacture is described such that the article has a bracket with a pair of parallel, spaced-apart arms affixed thereto, with a hole in each of the arms, the holes being aligned with each other and precisely spatially positioned relative to a fixed reference point on the article of manufacture which is external to the bracket in which the holes are made. In this manner, the cumulative imprecisions inherent in welding the bracket to the article and punching the holes in the bracket are not necessarily additive and a more precise spatial orientation of the holes with the reference point may be obtained.

7 Claims, 3 Drawing Sheets

METHOD FOR ALIGNING TUBE BRACKET HOLES

The present invention relates to a method for placing a pair of aligned holes in an attachment to a part, the pair of aligned holes being precisely spatially oriented relative to a fixed position on the part. More particularly, the present invention relates to such a method and the device for practicing the method, as well as the product of the method. Even more particularly, the present invention relates to punching a pair of aligned holes in the arms of a bracket affixed to an axle tube of a vehicle.

BACKGROUND OF THE ART

An axle tube of a vehicle is attached to the vehicle frame through fixtures connected to brackets attached to the axle tube during manufacture. The precision of the attachment is directly related to the combined precision of the placement of the bracket on the axle tube and the precision of placing the holes in those brackets. During manufacture, the brackets are attached to the axle tube. In this attachment, which typically is a weldment, the brackets cannot be placed sufficiently precisely that prepunched bracket holes can be aligned regularly with the requisite precision. Therefore, it has been the practice in the art to form at least one of the holes in at least one of the brackets after all of the brackets have been affixed to the axle tube. It has also been the practice in the art to form the at least one hole which needs to be precisely placed through drilling, which has proven to be insufficiently precise. This is particularly true when the at least one hole which needs to be precisely placed is a pair of holes which need to be in close alignment. An example of this would occur when the pair of holes are to be placed such that one of the holes is in each of a pair of spaced apart arms in the bracket.

SUMMARY OF THE INVENTION

It is, therefore, an object of the present invention to provide a method and device for manufacturing an article of manufacture having a bracket with a pair of parallel, spaced-apart arms affixed to the article of manufacture, such that a pair of holes are placed in the arms, one hole being in each of said arm. The holes are placed in the arms with precision of both size and alignment with a fixed point of reference on the article of manufacture other than the bracket. Such an improved method comprises the steps of securing the article of manufacture with the bracket already attached thereto in a device to restrict movement thereof relative to a punch tool having a first and a second die in opposing aligned relationship with a die block between the first and second dies and having a position indicator in fixed spatial relationship to the first and second dies; registering the position indicator upon the fixed point on the article of manufacture, such that the registering of the position indicator centers each of the first and second dies in a first position over the arms of the bracket with the die block positioned in a gap between the parallel, spaced-apart arms; activating the punch tool to drive the first and second dies forward to a second position in the arms of the bracket, the first and second dies and the die block coacting to pierce a hole in each said arm; withdrawing the first and second dies of the punch tool from the second position to the first position; and removing the article of manufacture from the movement restricting device.

BRIEF DESCRIPTION OF THE INVENTION

Better understanding of the present invention will be had when reference is made to the accompanying drawings, wherein identical pars are identified by identical reference numerals and wherein.

DETAILED DESCRIPTION OF THE PREFERRED EMBODIMENT

Figure 1:
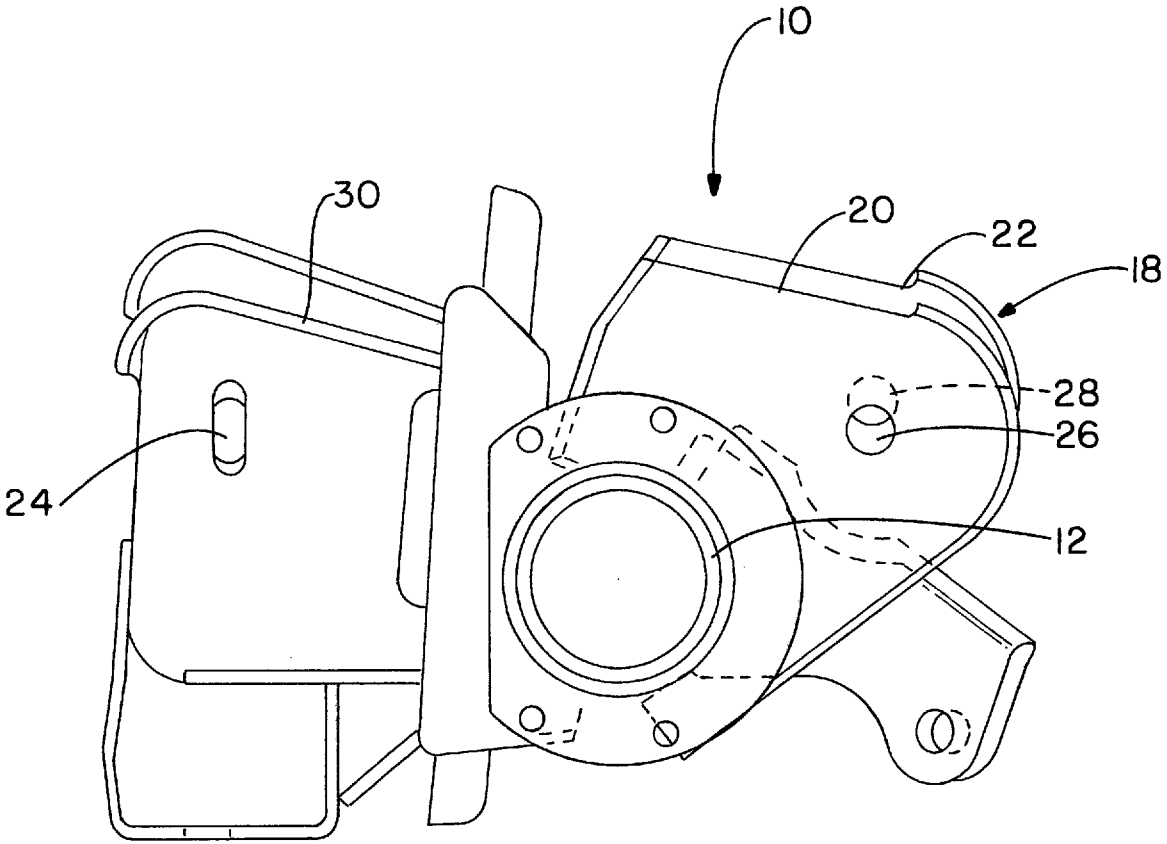
FIG. 1 shows an end view of an article of manufacture on which the present invention has been practiced.
Figure 2:
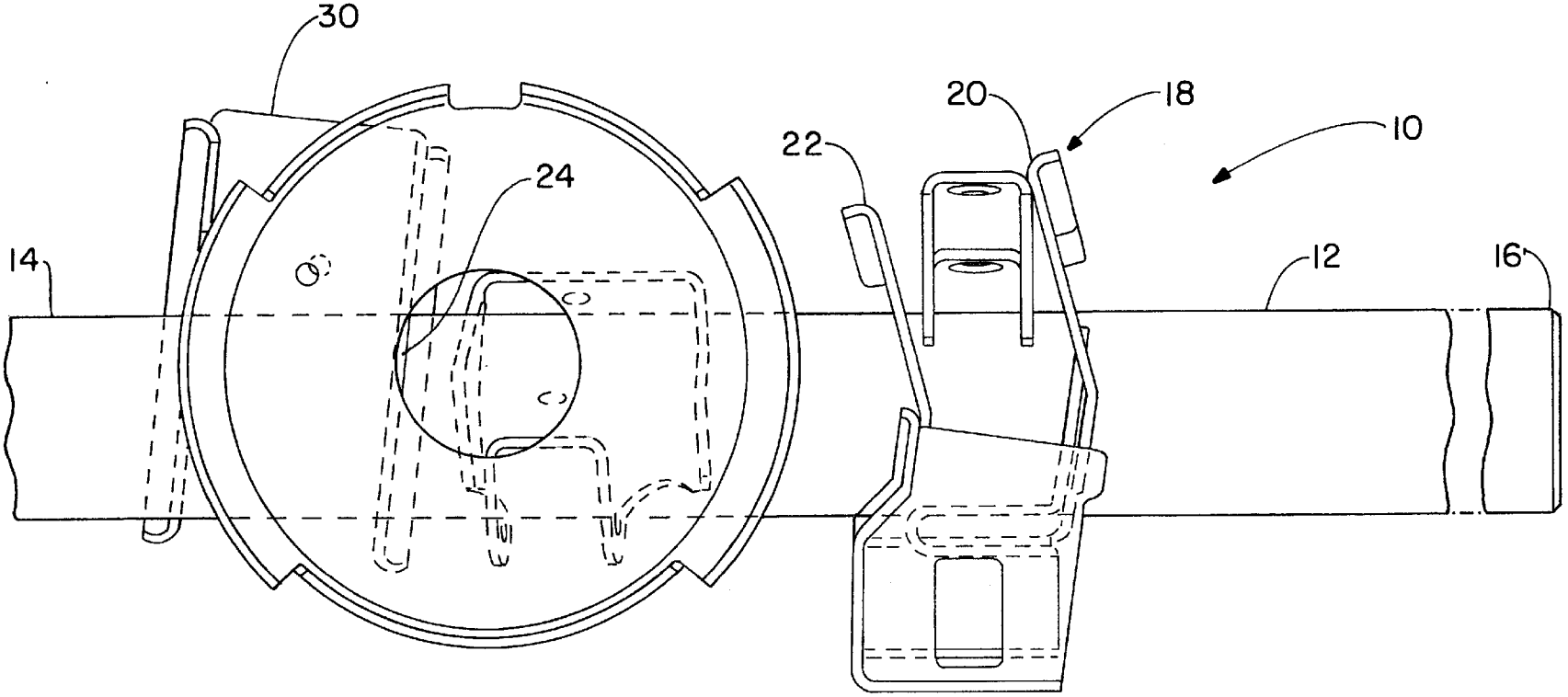
FIG. 2 shows a side elevation view of the article of manufacture of FIG. 1.

The method of the present invention will best be understood if understanding is obtained first of the article of manufacture worked upon and the preferred device for practicing the invention. The specific article of manufacture worked upon by the preferred device is an axle tube for a vehicle, as is shown in end and side views in FIGS. 1 and 2. The axle tube 10 as received is typically an elongate hollow cylindrical tube 12 with first and second ends 14, 16. A first bracket 18 with a pair of spaced apart parallel arms 20, 22 has been affixed, preferably by welding, along the length of the tube 12. At the time of receipt, each of the pair of arms 20, 22 lacks a hole. The intent of the invention is to align the pair of arms 20, 22 precisely with reference to at least one point 24 on the axle tube 10 external to the first bracket 18 so that a hole 26, 28 may be punched in each of the pair of arms 20, 22. In the particular case at hand, the reference point of interest 24 is a hole in a second bracket 30 which has been welded to the tube 12. The particular hole 24 in the case at hand is a hole pierced in the second bracket 30 prior to the second bracket being affixed to the axle tube 10. For this reason, it will be understood that the precise spatial relationship between the reference hole 24 in the second bracket 30 and the holes 26, 28 to be punched in the arms 20, 22 of the first bracket 18 would be dependent upon the cumulative precision of two separate welding operations and two separate punching operations, none of which has been conducted with reference to any of the preceeding operations. Although punching and welding can each be precise, the cumulative effects of slight imprecision at each step can result in unacceptable precision in the product.

Figure 3:
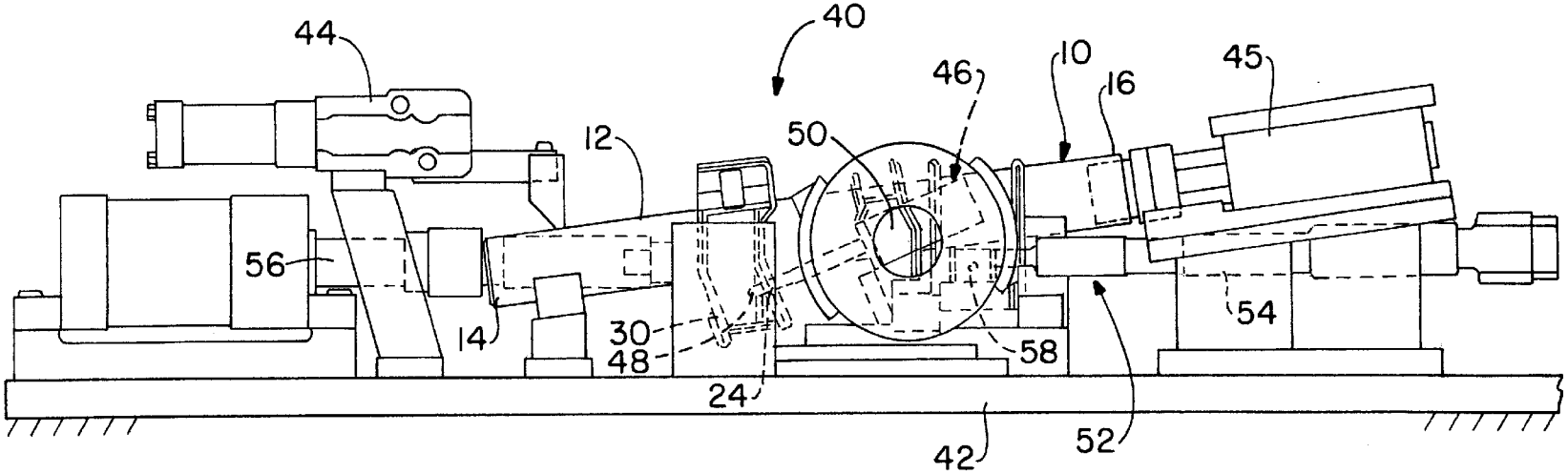
FIG. 3 shows a side view of the article of manufacture being aligned in a device for practicing the present invention.
Figure 4:
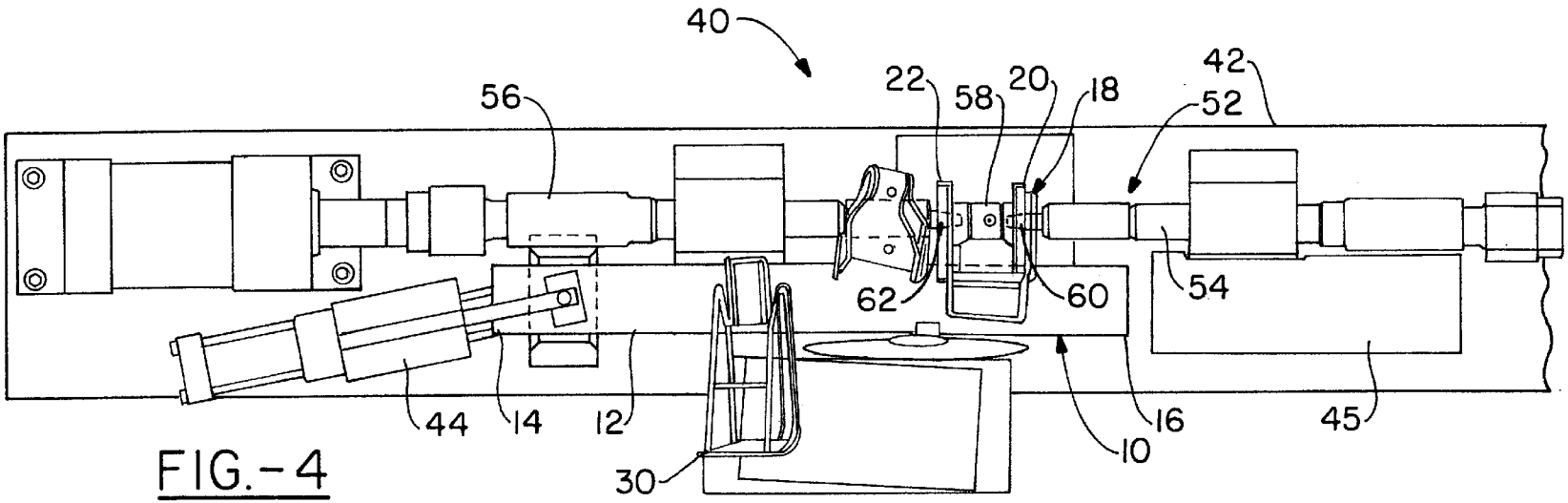
FIG. 4 shows a top view of the article of manufacture having holes punched therein using the device of the present invention.

With the general concept of the axle tube in mind, the preferred device 40 for working on the axle tube 10 is now introduced, as shown in FIGS. 3 and 4. FIG. 3 shows the device 40 in a side view which reveals the details of the clamping and aligning features and FIG. 4 shows a top view of the device which reveals the specifics of the punch features. The device 40 provides an essentially stable and secure base 42 upon which each of the elements may be affixed with precision. As with many precision tools, the device will be constructed for the purpose of performing a specific task upon a specific article, in this case, the axle tube 10. An axle assembly for a vehicle will typically have a right axle tube and a left axle tube with a differential housing between the axle tubes, and the left and right axle tubes will be essentially mirror images. When the axle tubes are to be worked upon prior to being formed into an axle assembly, it will be highly preferred to have a first device for operating on right axle tubes and a second separate device for operating on left axle tubes, to eliminate any imprecision introduced by building in operational flexibility. The stability required in the device is typically achieved by using a thick metal slab as a base, as is well known in the machining art. Components may be bolted or otherwise conventionally secured to the base 42 to maintain strict spatial relationship. The base is provided with first and second securing means 44, 45 for receiving and securing the respective first and second ends 14, 16 of the axle tube 10. Suitable clamps are known in the art and will be readily accessible to one of skill in this art. The first and second securing means 44, 45 are spatially positioned to each other to orient the axle tube 10 initially as it is securely clamped to the base at its first end 14 and movably clamped to the base at its second end 16, with the reference point 24 on the axle in general alignment with a position indicator 46 fixed to the base. With the first end 14 essentially fixed in space, slight movement of the second tube end 16 while still attached by securing means 45 to the base enables very precise alignment of the axle tube 10 so that the reference point 24 on the tube is very closely aligned with the position indicator 46, which in the present case may be a diamond locating pin 48 positioned in a cylinder 50 such that the locating pin may be inserted into a hole or bore 24 selected as the reference point. The adjustment means provided at the second end securing means 45 should permit adjustment in the three mutually normal axes so that combinations of adjustment can result from adjustment in the individual axes. It will be preferred, although it is certainly not necessary that the end of the tube or article of manufacture nearer the bracket to be pierced be selected as the second or movable end of the article, since this permits more facile adjustment. In some embodiments, it may be preferred to use a servomechanism or combination of servomechanisms to perform the adjustment function. As the position indicator 46 is registered on the reference point 24, the means 45 for securing the second end 16 of the tube 10 to the base is tightened into a locked position. With the first and second ends 14, 16 secured and the reference point 24 registered with the position indicator 46, the axle tube 10 is fixed in three dimensions to the base and should be ready for the punching step.

If the bracket 18 having arms 20, 22 to be punched has been affixed within acceptable tolerances to the axle tube 12, the steps of securing the first and second ends 14, 16 and moving the reference point 24 into registration with the position indicator 46 should have situated the bracket relative to a punch tool 52 so that a first die 54 on the punch tool is outside the first of the arms 20, a second die 56 on the punch tool is outside of the second of the arms 22 and a die block 58 is located in the gap or spacing between the arms. A punch detail 60, 62 in each of the first and second dies 54, 56 should be in a first withdrawn position at this point, with the punch detail in each die aligned with the die block 58 so that actuation of the punch tool 52 would result in the punch details being driven through the respective arms 20, 22, thereby coacting with the die block to pierce the body of the arm with a hole 26, 28 that is completely contained within the body of the arm. If this alignment of the punch details 60, 62 is obtained, then the punch tool 52 maybe locked into position with respect to the base (if it is not already so locked) and the punch tool may be actuated.

In some instances, the punch tool 52 will not be able to be aligned properly for piercing of the arms 20, 22 when the tube 10 is fixed at its first and second ends 14, 16 and the reference point 24 is registered with the position indicator 46. One such circumstance would occur when the first bracket 18 is simply out of position beyond the acceptable tolerances as set when assembling the punch device. When this occurs, the part should be removed and rejected as outside of tolerance. A second such circumstance occurs when the improper piece is placed into the device or a proper piece is improperly placed. For example, a right half axle tube placed in the left half axle tube device or a right half axle tube inserted backwards in the right half tube would not permit proper alignment of bracket with punch tool. When this second situation occurs, the part should be removed and properly inserted in the correct device.

Once the punch tool 52 is in a proper alignment with the bracket 18, the position indicator 46 is in registration with the reference point 24 and the tube ends 14, 16 are locked down by the clamps 44, 45, the punch tool 52 itself should be locked into position with respect to the base 42. This, of course, is conditioned upon the punch tool 52 being provided with any mobility relative to the base. In the most common situations, the punch tool 52 may be provided with some angular mobility to allow it to be swung in and out of position to facilitate insertion and removal of the tubes or other articles of manufacture being worked on, with the means for providing the mobility having a lock for holding the punch tool once it is in position. By fixing the punch tool 52 spatially relative to the base and fixing the position indicator 46 also relative to the base, the punch tool is effectively spatially fixed relative to the position indicator. In some embodiments, the structure of the workpiece, such as axle tube 10, may actually prefer that the position indicator 46 and the punch tool 52 be in invariant spatial orientation. In any case, the punch tool 52 must be firmly fixed before the tool is actuated, so that the position is held during the punching operation. One method of providing angular mobility of the punch tool 52 is to have the punch tool mounted rotatably on a fixed post affixed to the base 42, with the punch tool being lockable to a particular angular position by interposition of a pin through apertures in the relatively rotatable members.

When the punch tool 52 is properly aligned with a workpiece such as an axle tube bracket 18 affixed to an axle tube 12, the punch tool may be actuated, as by conventional means known in the punching art. Upon actuation, the punch detail 60, 62 contained within each of the first and second dies 54, 56 will be driven by externally supplied motive force from the withdrawn first position to an engaged second position, the stroke of the dies providing sufficient movement of the punch details in coaction with the die block 58 to pierce a hole 26, 28 in each of the arms 20, 22 of the bracket. If the first and second dies 54, 56 and the die block 58 are properly fixed to the punch tool 52 in an aligned relationship, actuation results in a pair of holes of precise diameter and alignment. The fixing of the punch tool 52 spatially relative to the reference point 24 results in the precise spatial alignment of the bore created by the pair of holes 26, 28 with the reference point 24. In the preferred embodiments, the first and second dies 54, 56 are actuated simultaneously, so that the punch details 60, 62 strike the arms essentially simultaneously, with each counteracting the force imposed by the other on the bracket.

The selection of the specific dies and the die block to be used will be known to one of skill in this art when the size and type of material to be pierced is determined. No special properties are expected to be required, other than that the dies should be firmly mountable to the punch tool with provision to adjust the position of each to align the dies with each other. It is to be expected that use of the device for punching axle tubes will result in movement of the dies over time, requiring realignment. In a particular application anticipated by the inventors, the dies will have pneumatic cylinders with a stroke in the range from about two to about two and one half inches.

After the dies 54, 56 have been actuated and the aligned holes 26, 28 pierced into the bracket arms 20, 22, the actuating force to the dies is terminated and the punch details 60, 62 withdraw to the first position. After this is accomplished, the clamps 44, 45 restraining the first and second ends 14, 16 of the tube 12 may be released, and the workpiece 10 removed from the device. The process is recommended by introduction of a new unpierced workpiece to the device.

An alternative method of performing the above operation would involve drilling of the holes by a pair of opposed drill bits acting from the outside surfaces of the bracket arms, but the present method of punching is believed to have the advantage of holding better alignment during operation and providing a more consistent diameter to the hole.

Since the present punching process is conducted after an alignment process which is dependent upon, and not independent of, the prior step of affixing the bracket to the tube, the alignment process is able to counteract, at least to within acceptable tolerances, the cumulative additive imprecisions of the prior steps, resulting in a more precise product than when the steps are conducted independently, particularly when the holes are punched prior to the welding process being performed. It will be understood that the inherent nature of the punching process is more spatially precise than the process of welding.

Although the present invention has been described above in detail, the same is by way of illustration and example only and is not to be taken as a limitation on the present invention. Accordingly, the scope and content of the present invention are to be defined only by the terms of the appended claims.

What is claimed is:

1. In a process for manufacturing an article of manufacture having a bracket with a pair of parallel, spaced-apart arms affixed thereto, a method for producing a pair of holes, one of the pair of holes in each of the pair of arms, the holes being aligned with each other and precisely spatially positioned relative to a fixed point on the article of manufacture external of the bracket, said process comprising the steps of:

(a) securing the article of manufacture in a device to restrict movement of the article relative to a punch tool having a first and a second die in opposing aligned relationship with a die block therebetween and having a position indicator in fixed spatial relationship to said first and second dies;

(b) registering the position indicator upon the fixed point on said article of manufacture, such that the registering of the position indicator centers each of the first and second dies in a first position over the arms of the bracket with the die block positioned in a gap between the parallel, spaced-apart arms;

(c) activating the punch tool to drive the first and second dies forward to a second position in the arms of the bracket, the first and second dies and the die block coacting to punch a hole in each of the arms;

(d) withdrawing the first and second dies of the punch tool from the second position to the first position; and (e) removing the article of manufacture from the movement restricting device.

2. The process of claim 1 wherein step (a) is accomplished by the movement restricting device having first and second means for securing the article which are positoned in precise fixed spaced apart relationship on the device such that when the first and second securing means are respectively attached to a first and a second reference point on the article of manufacture, the article of manufacture is roughly aligned with the punch tool such that the first and second dies are positioned outside the pair of arms, the die block is positioned between the pair of arms, and the position indicator is positioned near the fixed point on the article of manufacture.

3. The process of claim 2 wherein step (a) is accomplished by the movement restricting device having the punch tool movably affixed to the device.

4. The process of claim 1, further comprising rejecting the article of manufacture if, in step (b), the positioning indicator cannot be registered upon the fixed point without moving the first and second dies outside of the area between the arms.

5. The process of claim 1 wherein, in step (c), the first and second dies are driven simultaneously into the arms to punch a hole in each of the arms.

6. A process attaching a bracket to an article of manufacture such that each of a pair of spaced apart parallel arms of the bracket has a hole pierced therethrough, the holes in the pair of arms being in axial alignment and being spatially positioned relative to a fixed point on the article of manufacture external to the bracket, said process comprising the steps of:

(a) attaching the bracket with unpierced arms to the article of manufacture;

(b) aligning the article of manufacture with the bracket attached in a punching device so that first and second opposed dies and a die block of the punching device are positioned in axial alignment proximate to the arms of the bracket and are spatially oriented relative to the fixed point; and (c) simultaneously actuating the first and second dies to drive a punch in each die through respective arms of the bracket, thereby forming the holes in the pair of arms.

7. The process of claim 6 wherein the step of attaching the bracket to the article of manufacture comprising welding.

* * * * *